United States Patent [19]

MacPhee et al.

[11] Patent Number: 4,724,764

[45] Date of Patent: Feb. 16, 1988

[54] DAMPENING SYSTEM

[75] Inventors: John MacPhee, Rowayton, Conn.; Larry E. Lester, Anaheim, Calif.

[73] Assignee: Baldwin Technology Corporation, Stamford, Conn.

[21] Appl. No.: 58,704

[22] Filed: Jun. 5, 1987

Related U.S. Application Data

[63] Continuation of Ser. No. 797,950, Nov. 14, 1985, which is a continuation-in-part of Ser. No. 560,506, Dec. 12, 1983, abandoned, which is a continuation-in-part of Ser. No. 493,440, May 11, 1983, abandoned.

[51] Int. Cl.[4] ..... B41L 25/02; B41M 1/00

[52] U.S. Cl. ..... 101/451; 101/148; 101/349

[58] Field of Search ..... 101/142, 147, 148, 350, 101/425, 426, 450.1, 451

[56] References Cited

U.S. PATENT DOCUMENTS 3,467,008 9/1969 Domotor ..... 101/148 X
4,130,056 12/1978 Mabrouk et al. ..... 101/147 X

*Primary Examiner*—Edgar S. Burr
*Assistant Examiner*—Moshe I. Cohen
*Attorney, Agent, or Firm*—Morgan & Finnegan

[57] ABSTRACT

The invention relates to a system for applying dampening fluid to the plate cylinder of printing presses which is particularly adapted to contacting continuous dampening systems. The dampening fluid applying roller is in contact with the rotating plate cylinder and there is a wiping action between the dampening fluid applying roller and the plate cylinder which loosens foreign particles from the plate cylinder so they can be removed. The dampening fluid applying roller rotates at a different speed than the plate cylinder to cause the wiping action. Preferably, the dampening fluid applying roller rotates at a slower speed than the plate cylinder. In another form of the invention an ink receptive roller is driven at the same speed as the dampening or delta roller while in contact with the dampening roller.

10 Claims, 9 Drawing Figures

PRIOR ART INKING SYSTEM

PRIOR ART DAMPENING SYSTEM

PRIOR ART DAMPENING SYSTEM

DAMPENING SYSTEM

This Application is a continuation of application Ser. No. 797,950 filed Nov. 14, 1985, which in turn is a continuation in part of application Ser. No. 560,506 filed Dec. 12, 1983, now abandoned, which is a continuation in part of Ser. No. 493,440 filed May 11, 1983, now abandoned.

BACKGROUND OF THE INVENTION

This invention relates to a new and improved dampening system for use in connection with lithographic printing presses. Generally speaking, the invention relates to a new and improved dampening system of the continuous contacting type but is not necessarily limited thereto which is particularly useful in connection with lithographic printing presses. More particularly, the invention relates to a new and improved dampening system for applying fountain solution in connection with lithographic presses wherein there is a differential surface speed between the dampening roller and the plate cylinder which results in improved performance achievement in the areas of reduced ghosting hickey removal and reduced ink feedback into the dampening solution and improved printing.

It is well known that the lithographic offset printing plate is treated chemically so that there are printing and nonprinting areas so that the printing area is receptive to ink. The non-printing area, on the other hand, is hydrophilic and accepts moistening fluid. In order to achieve the desired printing, a film of moistening fluid is applied to the surface of the plate which is retained by the hydrophilic area but is repelled by the printing area in order that the printing area receives the printing ink. The non-printing area, however, is separated and isolated from the printing ink by the film of moistening fluid. In this manner only the image of the printing area is transferred to the blanket cylinder and onto the paper on which the image is printed.

Generally speaking, there are two classifications of dampening systems: contacting and noncontacting. The noncontacting type consists of the brush and spray type system wherein there is a physical gap in the path the dampening fluid takes to the plate. In such systems there is no ink feedback into the dampening system fluid.

The contact category of dampening systems has two broad sub-categories; namely, continuous systems, and conventional, or ductor type systems which utilize fabric covered or bareback form rollers. It is generally accepted that continuous dampening systems are preferred because they produce high quality printing and are relatively maintenance free because cloth or paper covered rollers are not required. On the other hand, a disadvantage of continuous systems is the problem of ghosting on the printed material.

The continuous type dampening systems may be classified into three groups, i.e., plate feed systems, ink feed systems, and combination type systems.

In the plate feed type system, dampening solution is applied directly to the plate by a series of rollers which are independent from the inking system. In such a system there is a roller in contact with a supply of dampening fluid which is transferred to a dampening form roller via an intermediate roller. The dampening form roller is in rotating contact with the plate cylinder to thereby transfer the dampening fluid. Another series of rollers including an ink form roller and a vibrating roller transfers ink to the plate cylinder.

The inker feed-type system functions so that the dampening solution is fed to one of the ink system rollers rather than to the plate. Generally, the dampening fluid is directed to the first ink form roller.

In the combination type system a separate dampening form roller is provided which applies dampening fluid to the plate. In the combination type the dampening roller is connected to the inking system by a vibrating bridge roller. A typical example of the combination system is illustrated in U.S. Pat. No. 4,290,360.

The inker feed continuous-type dampening system is widely used in the printing industry even through there are areas where improvement would be desirable. One problem with the inker feed continuous type dampening system is that the stripe setting of the vibrator roller to the first ink form roller and the first ink form roller to the plate cylinder is very critical. This setting is critical because the first ink form roller runs at essentially the same speed as the plate cylinder and is friction driven by the vibrator roller and the plate cylinder. In certain instances, e.g., sheetfed presses, there is a large gap in the plate cylinder so that there are substantial time periods during the plate cylinder revolution where the only drive for the first form roller is through frictional contact with the vibrator roller. This can be troublesome because the dampening fluid on the surface of the roller is slippery, making driving contact difficult. In addition, the slip nip between the rollers is an additional load which tends to slow down the roller. In order to insure that the form roller runs at the same speed as the vibrator roller, it is generally considered necessary to maintain a relatively large stripe between the vibrator roller and the first ink form roller. If this stripe is not heavy enough or if the plate cylinder strip is too heavy, there will be speed variations resulting in poor printing. But, on the other hand, where a heavy stripe is required to the vibrator roller, good ink transfer is interfered with which contributes to the problem of mechanical ghosting. As used herein, mechanical ghosting refers to the appearance of an unwanted phantom image in a printed area. Ghosting is a faint image of a repeat of some other printed area or a repeat of one of the regions of the same printed area.

The cause is the same in both types of mechanical ghosting, and is related to the principle which governs ink transfer from an inking roller to the plate in the press. That is, when an ink roller transfers ink to the printing plate, a mirror image of the printed area is formed on the ink roller. The boundary of this mirror image represents the dividing line between (i) those areas of the roller which contacted and transferred ink to the ink receptive image area of the plate and (ii) those areas of the inked roller which transferred no ink but received a charge of dampening fluid as a result of contacting the dampened non-image areas of the plate.

Thus, the ink form rollers (i.e. those in contact with the plate cylinder) contain areas of thinner ink films and little dampening fluid and areas of thicker ink films having much emulsified water, which produce undesired phantom images on the printed form.

Inker feed dampening systems have been in widespread use in the industry for about ten years. A typical inker feed dampening system is described and shown in U.S. Pat. No. 3,168,037.

There are certain advantages to these systems such as less maintenance in that cloth or paper coverings for rollers are not required. There is a very fast response time at the begining of a run so that very few sheets are lost due to waste and there are less demands on the operator.

In a typical inker feed dampening system the dampening solution is metered into a relatively thin film by the metering nip formed between the chrome transfer roller and the resilient metering roller. Typically, these rollers are geared together and driven at the same surface speed by a separate variable speed motor. Due to the fact that the rollers are run at the same surface speed, the thickness of the dampening fluid film at the exit of the nip is determined by the speed of the rollers, the hardness of the resilient roller, the pressure between the rollers and the viscosity of the dampening fluid.

Generally speaking, all of these factors tend to remain constant except for the speed of the rollers so that the thickness of the dampening fluid at the exit of the metering nip and the feed rate of the dampening solution is varied by using the variable speed controller to vary the speed of the transfer roller and the resilient metering roller. The metered film of dampening solution goes to the nip between the first ink form roller and the transfer roller and some dampening solution is transferred from the first form roller to the plate cylinder. The transfer roller and the metering roller run at a slower speed and a "slip nip" is formed at the juncture of the transfer roller and the first form roller.

With the above described arrangement it is generally found necessary, except on very small presses, for the metering roller to be skewed so as to provide a greater dampening fluid feed rate at the ends than at the middle of the rollers. In addition, it has been found that isopropyl alcohol must be added to the fountain solution so that it remains in a thin film rather than agglomerating into small water droplets.

Another problem with the aforesaid arrangement is that when the presses are run at high speeds the slip nip can cause emulsification of the fountain solution and ink resulting in small particles of ink being fed back and disbursed in the fountain solution which causes an effect known as tinting, which means that non-image areas on the printed sheet appear to be tinted. One solution to the problem is offered by U.S. Pat. No. 3,937,141. The solution offered by the aforesaid patent is to rearrange the rollers so that the slip nip is moved to a point where there is no ink. The chrome transfer roller is run at the same speed as the ink form roller and the resilient metering roller also functions as the fountain pan roller. In this modification, the fountain pan roller is driven by a variable speed motor which controls the fountain solution feed rate. A slip nip is, therefore, formed only where there is fountain solution present. This arrangement provides a partial solution to the emulsification or ink feedback problem but requires that the first ink form roller and the transfer roller be friction driven thus placing a greater demand on the vibrating roller. Additional maintenance problems are presented where the resilient roller is used as the fountain pan roller.

A problem with continuous systems has been ghosting. There have been several efforts to solve the ghosting problem arising in plate feed type systems.

One proposal to solve the ghosting problem is to use a separate dampening form roller but in this proposal a vibrating bridge roller is used to connect the dampening form roller to the first ink form roller.

The foregoing system has been modified in several ways. One modification was to provide a mechanism to move the vibrating bridge roller whereby the dampening system can be disconnected from the ink system during certain phases of the printing operation. Thus, the vibrating bridge roller can be moved out of engagement with the dampening form roller so as to reduce the problem of ghosting.

In summary, the prior art can be generally characterized as having the following characteristics:

1. The form roller which supplies dampening fluid to the plate is run at essentially the same surface speed as the plate cylinder.

2. The water feed rate is controlled by a separate motor drive which drives at least one of the dampening system rollers at a slower speed than the plate cylinder.

3. The initial metering of the dampening fluid into a thin metered film is caused by forming a metering nip between two rollers. Where the press is wide the rollers must be skewed so that there is a higher rate of feed at the ends of the roller.

While these prior art systems have found industry acceptance due to their fast response time, reduction of waste and less need for skilled operators, several areas remain for improvement.

One problem area involves the tendency for ghosting to occur despite prior efforts to prevent it from occurring. In addition, the prior art systems tend to have an initial high cost, and the slip nips cause emulsification which can result in ink feedback into the fountain solution which can cause tinting. Also, some prior art systems require the addition of alcohol to the fountain solution.

There is also known in the prior art an inking system (sometimes referred to as the "Delta System") which is used to reduce the accumulation of foreign particles (referred to as "hickeys") on lithographic printing plates during printing. This system is illustrated in U.S. Pat. No. 3,467,008 issued to Domotor. The Domotor patent is directed to a conventional system having one set of rollers for applying ink and another set of rollers for applying dampening solution. The dampening system in Domotor is not a continuous system and employs the conventional ductor roller.

In the sytem described in the Domotor patent, a gear drive is added to the first ink form roller so that it is driven at a lower surface speed relative to the speed of the plate cylinder and the vibrator roller. This causes two slip nips to form, one at the nip between the first ink form roller and the plate cylinder, and the second at the nip between the first ink form roller and vibrator roller. A scrubbing action occurs at the slip nip adjacent the plate cylinder which causes hickeys to be removed from the plate cylinder. The hickeys are transported along the ink train and are collected on a rider roller or in the ink fountain. This system, it has been found, substantially increases production and results in improved inking particularly in solid areas.

The Domotor system does have certain limitations. One is that the initial cost is high caused in part by designing a gear drive for the ink form roller. Another limitation is the relatively high power requirement of the drive for the ink rollers and the need for helical drive gears to eliminate gear streaks.

In addition, the system described in the Domotor patent has, heretofore, been used only with conventional ink and dampening systems. This has occured because it was thought necessary to run the dampening form roller at the same speed as the plate cylinder. It this was not done it was feared that slurring of halftones and slurring of the trailing edges of solids would result.

Another problem that occurs is where a bridging roller is used which is run at the same speed as the dampening form roller which can result in ink emulsification and ghosting.

OBJECTS OF THE INVENTION

In view of the foregoing, it is an object of this invention to provide a new and improved dampening system.

Another object of this invention is to provide a new and improved dampening system having improved performance achievements.

Another object of this invention is to provide a new and improved dampening system which is inexpensive to manufacture.

A further object of this invention is to provide a new and improved dampening system which substantially eliminates ghosting in continuous type lithographic dampening systems.

An object of this invention is to provide a new and improved dampening system having a less expensive drive mechanism.

A further object of this invention is to provide a new and improved dampening system which substantially eliminates foreign particles and/or hickeys in a simple expeditious manner.

Another object of this invention is to provide a new and improved dampening system wherein there is a differential surface speed between the dampening roller and the plate cylinder so that foreign matter and/or hickeys are removed and ghosting is substantially reduced.

A still further object of this invention is to provide a new and improved dampening system for lithographic presses wherein the dampening roller and the plate cylinder rotate and at different surface speeds to remove foreign particles and/or hickeys.

Another object of this invention is to provide a new and improved dampening system which prevents ink feedback into the dampening solution.

Another object of this invention is to provide a new and improved dampening system having a dampening roller having a different surface speed than the plate cylinder so that there is a wiping action which removes foreign particles.

Another object of this invention is to provide a new and improved process for use in connection with lithographic printing presses for improving printing quality by reducing ghosting.

A further object of this invention is to provide a new and improved process for use in lithographic printing presses of the contacting continuous type wherein the dampening fluid is applied so as to loosen foreign particles and substantially reduce ghosting.

Another object of this invention is to provide a new and improved process for use in connection with lithographic printing presses of the contacting continuous type having a plate cylinder and a dampening roller wherein the plate cylinder and dampening roller rotate at different surface speeds so as to cause a wiping action which loosens foreign particles from the plate cylinder.

A still further object of this invention is to provide a new and improved dampening system which uses an ink receptive roller in contact with the dampening roller and driven at the same speed so as to prevent emulsification of the ink and subsequent ghosting.

Additional objects and advantages of the invention will be set forth in the description which follows and, in part, will be obvious from the description; the objects and advantages being realized and attained by means of the instrumentation, parts, apparatus, systems, steps and procedures particularly pointed out in the appended claims.

BRIEF DESCRIPTION OF THE INVENTION

Briefly described, the present invention relates to a new and improved dampening system. More particularly, in the preferred embodiment, the invention relates to an improvement for a dampening system of the continuous type wherein the speed of the roller carrying the dampening fluid is different relative to the plate cylinder speed. In a preferred embodiment the speed of the dampening roller is less than the speed of the plate cylinder.

Broadly speaking, the invention includes a dampening form roller, a dampening fluid transfer roller, and a conventional metering mechanism for metering the dampening fluid. The dampening form roller can be conveniently interconnected to the drive mechanism for the lithographic press so that the dampening form roller runs at a constant speed which is less than the plate cylinder speed so that there is a wiping action between the form roller and the plate cylinder which loosens foreign matter and/or hickeys so that they can be subsequently removed. An unexpected benefit of the invention is that ghosting is substantially eliminated which is normally a problem with continuous systems.

The first dampening form roller may be gear driven through gear interconnection with the chrome transfer roller at a speed which is intermediate the transfer roller and the plate cylinder.

In other embodiments an ink receptive roller is in surface engagement with the dampening roller and driven at the same speed so as to prevent ink emulsification and subsequent ghosting.

The invention consists of the novel parts, constructions arrangements and improvements shown and described.

The accompanying drawings which are incorporated in and constitute a part of this specification illustrate an embodiment of the invention and together with the description serve to explain the principles of the invention.

OF THE DRAWINGS

FIGS. 1(*a*), (*b*) and (*c*) are schematic drawings illustrating certain of the prior art devices and practices.

DETAILED DESCRIPTION OF THE INVENTION

Figure 1:
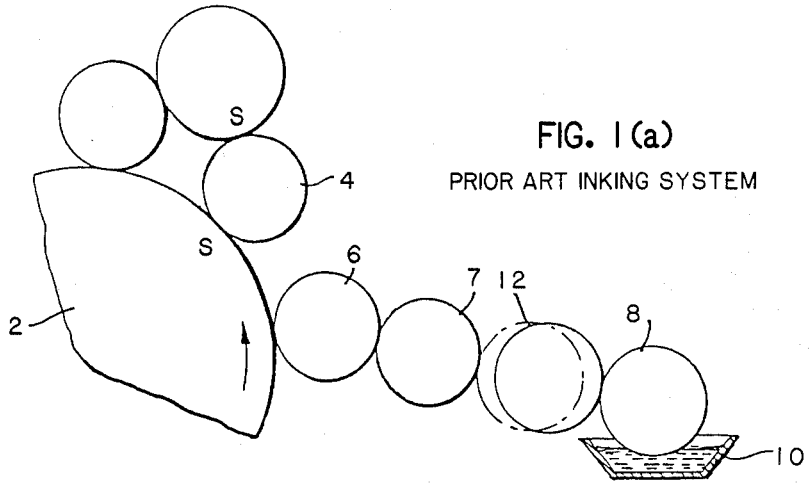
Figure 1:
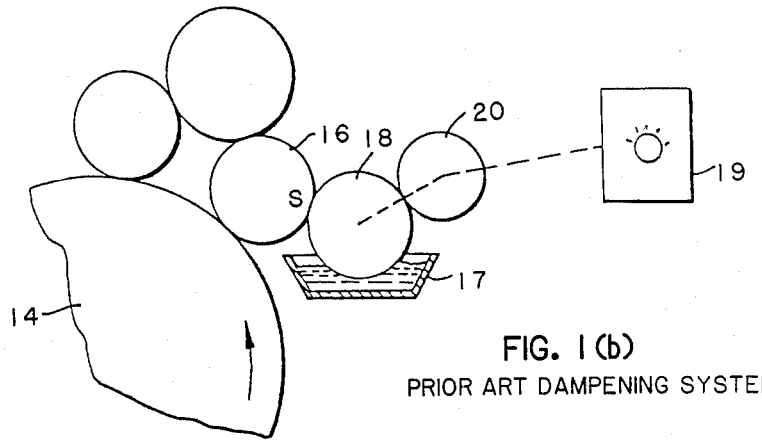
Figure 1:
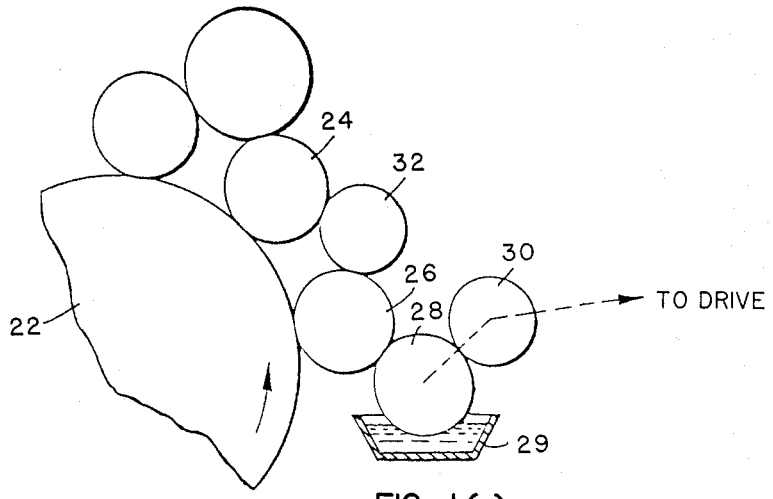

Referring to FIG. 1(*a*), there is shown in schematic form the means and method for removing foreign particles from lithographic presses as shown in more detail in U.S. Pat. No. 3,467,008 issued to Domotor. Such a system has been referred to herein as the "Delta" system.

As shown therein there is a rotatable lithographic plate cylinder 2 which rotates in a counterclockwise direction by conventional means not shown.

In the ink system shown in FIG. 1(*a*) there is illustrated an ink form roller 4, a dampening form roller 6, a vibrating roller 7 and a pan roller 8 rotating in the pan supply 10 containing fountain solution. The ductor roller 12 moves from an engagement position with the pan roller 8 to the dotted position where the dampening form roller 6 can transfer the dampening fluid to the rotating cylinder 2 received from the vibrating roller 7. The ink form roller 4 is moving in the same direction as the plate cylinder at their point of contact but at a slower surface speed. Slip nips are at the points labeled "S". This arrangement it has been found substantially eliminates foreign particles known as hickeys so as to improve what is referred to in the trade as ink laydown.

In the system the roller 4 is part of the inking system which cooperates to remove the hickeys.

FIG. 1(*b*) is a schematic showing of prior art dampening system taught by various U.S. Patents such as U.S. Pat. Nos. 3,168,037; 3,259,062; 3,343,484; and 3,937,141. In such dampening systems there is a plate cylinder 14 in engagement with a first ink form roller 16 which in turn is in engagement with a chrome pan roller 18 which rotates within a fountain solution pan 17. A metering roller 20 is provided which meters the fountain solution. The metering roller 20 is driven by a separate drive motor and controller 19 while the pan roller 18 is in geared relationship with the metering roller 20 so as to rotate the pan roller 18. In this system foreign particles (hickeys) can cause printing problems.

In FIG. 1(*c*) another prior art dampening form of mechanism is illustrated in schematic form.

In this device there is a rotating plate cylinder 22, a first ink form roller 24, and a dampening form roller 26. Optionally, there may be a bridge roller 32 between and in engagement with the first ink form roller 24 and the dampening roller 26. The pan roller 28 rotates in the fountain solution pan 29 and is in engagement with the dampening form roller 26 and the metering roller 30. The metering roller is driven by a separate drive motor and controller (not shown).

Figure 2:
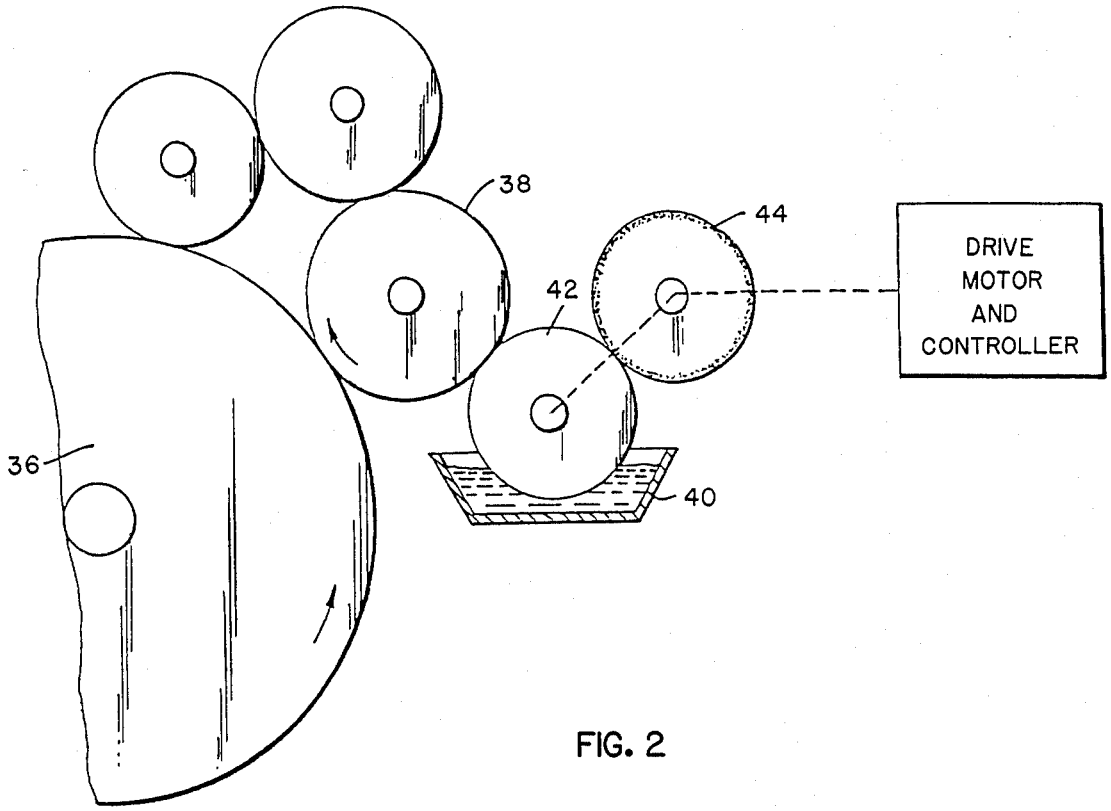
FIG. 2 is a schematic view of one embodiment of the invention.

Referring to FIG. 2, there is shown in schematic form a first embodiment of the invention herein wherein there is a continuous inker feed type dampening system.

In accordance with this invention, dampening means are provided wherein the ghosting is substantially eliminated and hickeys and other foreign matter are removed.

As embodied, this means includes a rotatable plate cylinder 36 rotating in a counterclockwise direction.

The rotating plate cylinder 36 is in engagement with a first ink form roller 38 which is rotated in the opposite direction as the plate cylinder, namely, in a clockwise direction. In this way the surfaces of these rollers are moving in the same direction at the point of their contact. The dampening system in accordance with this invention includes a dampening fluid pan 40 within which extends a chrome pan roller 42. The chrome pan roller 42 is in rotating engagement with a resilient metering roller 44. Preferably, the resilient metering roller is rubber covered. There is a separate drive motor and controller for the metering roller. The metering roller meters the film of dampening fluid.

The metering roller 44 is geared to the chrome pan roller 42 which in turn contacts the first ink form roller 38. The ink form roller moves in the opposite direction at the point of contact and at a slower surface speed than the plate cylinder. The difference in speed causes a wiping action between the plate cylinder 36 and the first ink form roller 38 to thereby loosen and remove foreign debris sometimes referred to as hickeys which accumulate in the ink regions of the plate cylinder.

Figure 3:
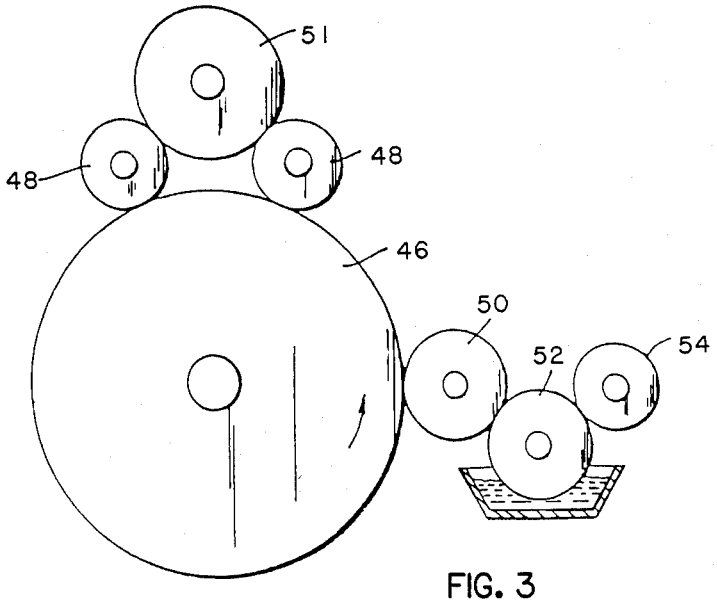
FIG. 3 is a schematic view of another embodiment of the invention.

FIG. 3 illustrates another embodiment of this invention known as the continuous plate feed type dampening system.

In this system there are separate ink systems and dampening systems. As illustrated there is a plate cylinder 46 and ink form rollers 48 in rolling contact with the vibrating roller 51. The dampening fluid applying roller 50 is in contact with the dampening roller 52 which in turn is in contact with the metering roller 54.

In this embodiment, the dampening fluid applying roller 50 is driven at a slower surface speed than the portion of the plate cylinder 46 which it contacts so as to cause a wiping action which loosens foreign particles and permits their removal.

This system has the advantage that hickeys are removed. In addition, there is considerably less power required for driving the dampening fluid applying roller 50 because one of the rollers it contacts is covered only with dampening fluid.

Figure 4:
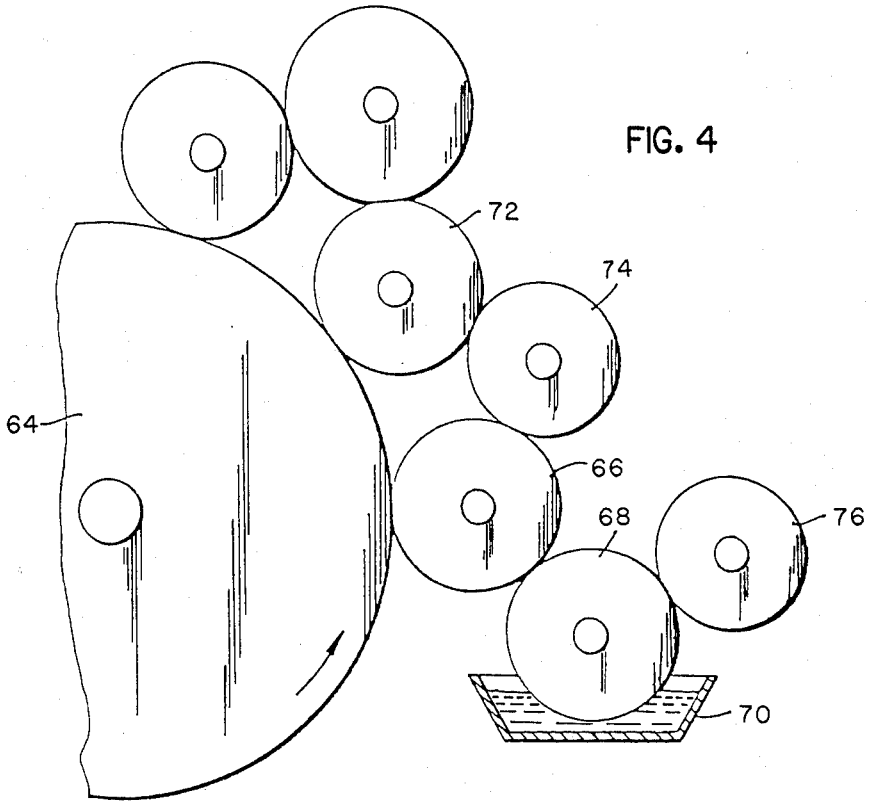
FIG. 4 is a schematic view of another embodiment of the invention.

FIG. 4 illustrates in schematic form another embodiment of the invention. This embodiment of the invention relates to the combination version of the present invention. In this embodiment there is a plate cylinder 64, a dampening form roller 66 and a pan roller 68 rotating in the fountain pan 70. There is also a first ink form roller 72 and a bridge roller 74 between the first ink form roller and the dampening form roller. A conventional metering roller 76 may also be used to meter the dampening fluid.

The common denominator for all the embodiments of this invention is that the dampening fluid applying roller applies dampening fluid solution to the plate cylinder while moving at a different surface speed (preferably slower) than the plate cylinder. With such an arrangement foreign particles are loosened and ultimately removed, ghosting is substantially reduced, power consumption is reduced, and ink feedback to the dampening fluid is lessened.

In accordance with the present invention means is provided for preventing excessive ink emulsifiaction which may occur in certain circumstances resulting in ghosting. Thus, for example, where an ink receptive roller is employed in engagement with the dampening form roller, which is running at a slower speed than the plate cylinder, ghosting may occur. If the ink receptive roller is driven at the same speed as the plate cylinder, excessive ink emulsification may result.

As embodied, this means includes an ink receptive roller which may also function as a bridging roller. The ink receptive roller is in contact with the dampening roller and is driven at the same speed as the dampening roller.

While the embodiments of FIGS. 2–4 represent a substantial improvement over prior art practices, there are certain circumstances where excessive ink emulsification and considerable ghosting may occur. Thus, the embodiments of FIGS. 2, 3 and 4 have been modified as illustrated in FIGS. 5, 6 and 7, respectively.

Figure 5:
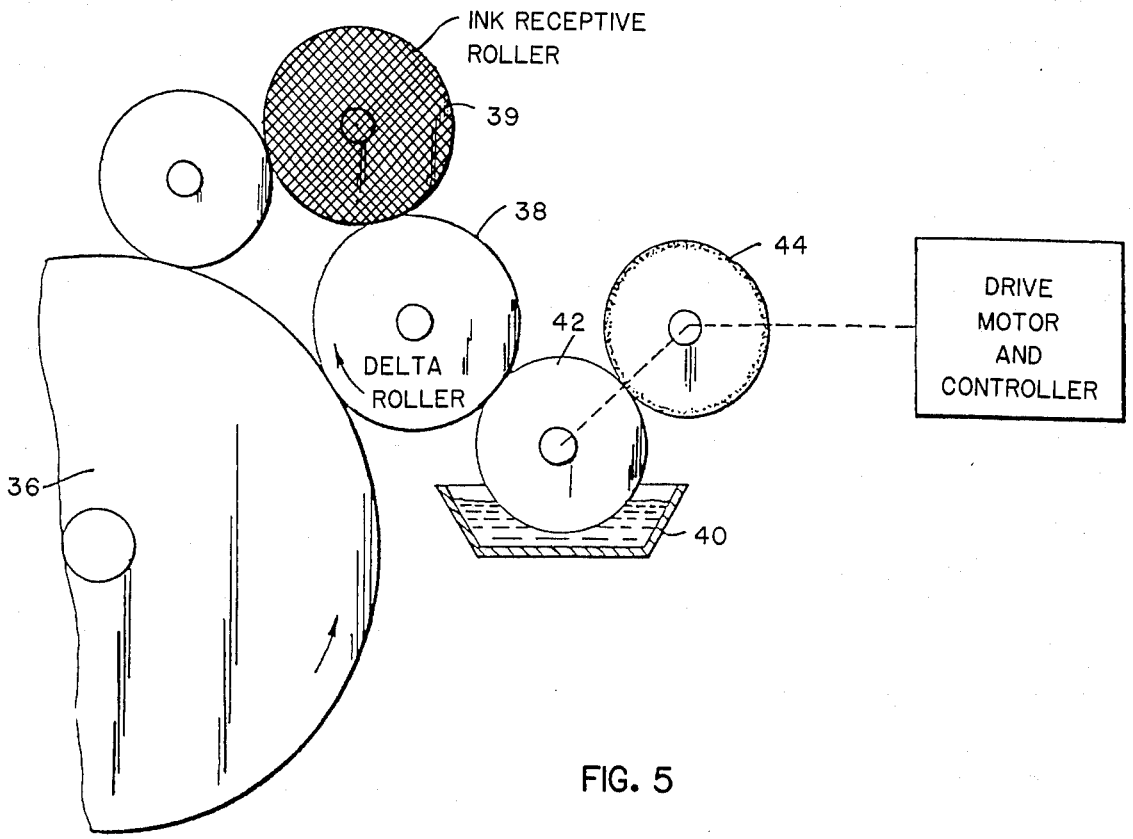
FIG. 5 is another embodiment of the invention similar to FIG. 2 having a bridging or ink receptive roller.
Figure 6:
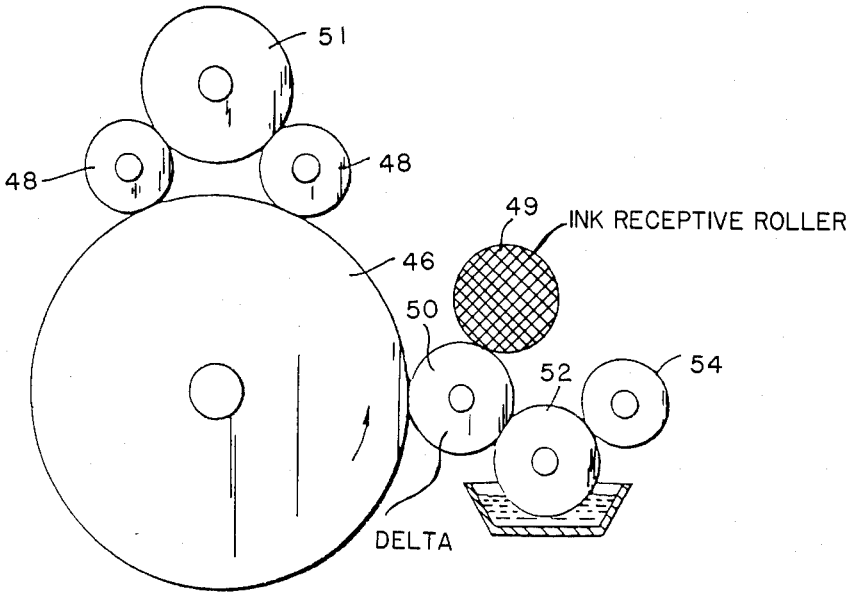
FIG. 6 is another embodiment of the invention similar to FIG. 3 having an ink receptive roller in contact with the dampening form roller.
Figure 7:
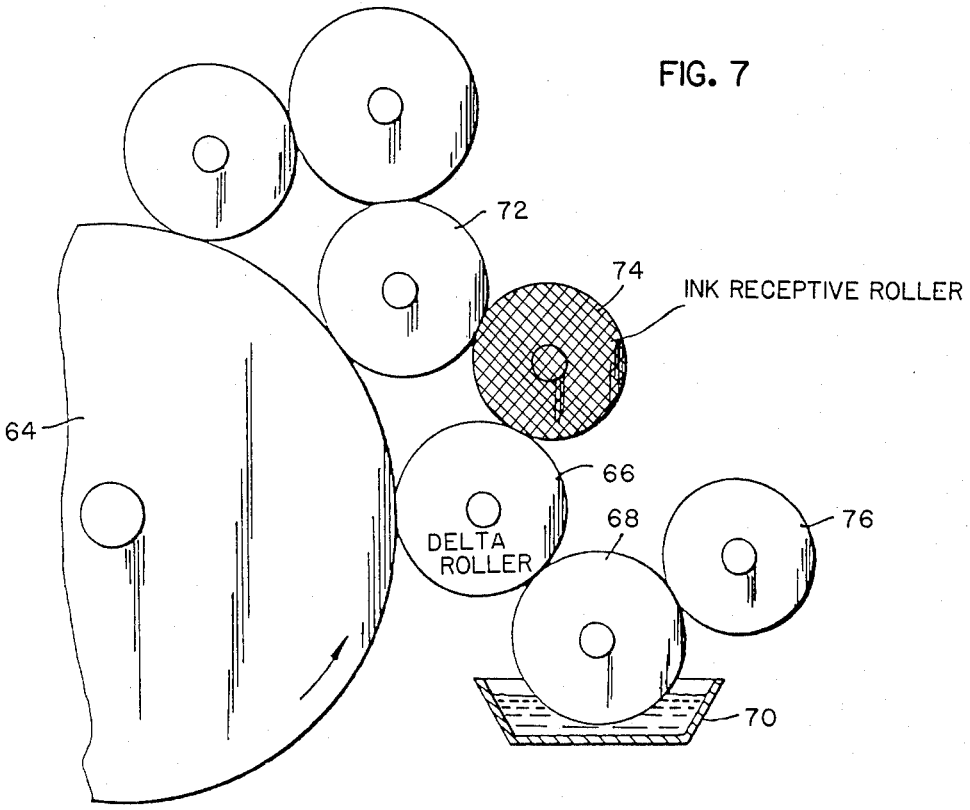
FIG. 7 is another embodiment of the invention similar to FIG. 4 having a bridging or ink receptive roller.

These modifications of FIGS. 5, 6 and 7 are the same as those shown in FIGS. 2, 3 and 4 and the same descriptions, references and numerals apply except as modified hereafter.

With reference to FIG. 5, an ink receptive roller 39 is shown in contact with the dampening roller 38 and is driven at the same surface speed as the dampening roller by conventional means not shown. This can be accomplished in any convenient manner known to the art such as meshing gears between the dampening roller 38 and the ink receptive roller.

FIG. 6 shows an embodiment of the invention similar to FIG. 3 showing an ink receptive roller 49 in contact with the dampening roller 50. The ink receptive roller 49 is driven at the same surface speed as the dampening roller by conventional means, not shown, which are well known in the art.

FIG. 7 is a variation of the device shown in FIG. 4. In this modification there is shown a bridge roller 74. The modification is that in accordance with this modification the bridge roller 74, which is in contact with the dampening roller 66, rotates at the same speed as the dampening roller. As in the case of the embodiments of FIGS. 5–6, such an arrangement prevents excessive ghosting and ink emulsification.

What is claimed is:

1. In a continuous contact lithographic press having an inking system in continuous contact with a dampening system for feeding ink and dampening fluid continuously to a rotatable plate cylinder, a device for dampening the rotatable plate cylinder of the lithographic press of the type having drive means for rotating said plate cylinder and for rotating the other rollers in the lithographic press system comprising:

(a) a pan supply of dampening fluid, (b) pan roller means rotating in said supply of dampening fluid, (c) metering means in cooperative relationship with said pan roller adapted to meter the thickness of dampening fluid, (d) a rotating dampening roller in continuous contact with said pan roller and in contact with said rotating plate cylinder and adapted to receive on its surface metered dampening fluid whereby dampening fluid is transferred from said dampening fluid supply to said rotating roller and to said plate cylinder, (e) an ink receptive roller and means mounting said ink receptive roller in surface contact with said rotating dampening roller;

(f) said drive means being operatively associated with said plate cylinder to cause rotation thereof said drive means being operatively associated with said rotating dampening roller to cause rotation thereof;

(g) means to remove foreign particles from said plate cylinder by said rotating dampening roller, said means to remove including means in said drive means to rotate said plate cylinder and said rotating dampening roller at different surface speeds to provide a wiping action between said plate cylinder and said rotating dampening roller, and (h) means to control ink emulsification and reduce ghosting, said means to control and reduce including said ink receptive roller being in contact with said rotating dampening roller, and means in said drive means to rotate said ink receptive roller and said plate cylinder at different surface speeds.

2. A device as defined in claim 1 wherein said rotating roller and said ink receptive rollers rotate at the same speed.

3. A device as defined in claim 1 wherein said rotating roller and said ink receptive roller have a slower surface speed than said plate cylinder.

4. A device as defined claim 3 wherein the dampening system is of the inker feed type.

5. A device as defined in claim 3 wherein the dampening system is of the plate feed type.

6. A device as defined in claim 3 wherein the dampening system is of the combination type.

7. A process of removing hickeys and preventing ghosting by applying dampening solution to the plate cylinder of a lithographic printing press of the type having a continuous dampening system comprising the steps of:

a. rotating the plate cylinder;

b. providing a supply of dampening fluid and a pan roller having a hydrophilic surface, c. providing a dampening fluid applying roller in continuous engagement with said pan roller and in contact with the surface of the plate cylinder and providing an ink receptive roller in engagement with the dampening roller;

d. causing a metered supply of dampening fluid to be on the surface of the dampening fluid applying roller;

e. removing hickeys by rotating the dampening roller at a different surface speed than the plate cylinder causing a wiping action between the surfaces of the dampening roller and the plate cylinder; and f. preventing ink emulsification by rotating the ink receptive roller in engagement with the dampening roller at a different surface speed than the plate cylinder.

8. A process as defined in claim 7 having the step of:

a. rotating the plate cylinder at one surface speed and the dampening fluid applying roller at another surface speed.

9. A process as defined in claim 8 having the step of:

a. rotating the dampening fluid applying roller and said ink receptive roller at a slower surface speed than the plate cylinder.

10. In a contact lithographic press having an inking system in continuous contact with a continuous contact dampening system having a plurality of rotating dampening rollers for feeding ink and dampening fluid continuously to a rotatable plate cylinder, a device for dampening the rotatable plate cylinder of the lithographic press of the type having drive means for rotating said plate cylinder and for rotating the other rollers in the lithographic press system comprising;

(a) a pan supply of dampening fluid, (b) pan roller means rotating in said supply of dampening fluid, (c) metering means in cooperative relationship with said pan roller adapted to meter the thickness of dampening fluid, (d) one of said dampening system rollers being in continuous contact with said pan roller, (e) one of said dampening system rollers being a rotating contact roller in contact with said rotating plate cylinder and adapted to receive on its surface metered dampening fluid whereby dampening fluid is transferred from said dampening fluid supply to said rotating contact roller and to said plate cylinder, (f) an ink receptive roller and means mounting said ink receptive roller in surface contact with said rotating contact dampening roller;

(g) means to remove foreign particles from said plate cylinder by said rotating contact dampening roller, said means to remove including means in said drive means to rotate said plate cylinder and said rotating contact dampening roller at different surface speeds to provide a wiping action between said plate cylinder and said rotating dampening roller, and (h) means to control ink emulsification and reduce ghosting, said means to control and reduce including said ink receptive roller being in contact with said rotating contact dampening roller, and means in said drive means to rotate said ink receptive roller and said plate cylinder at different surface speeds.

* * * * *

US004724764B1

REEXAMINATION CERTIFICATE (2394th)

United States Patent [19]

MacPhee et al.

[11] B1 4,724,764

[45] Certificate Issued Sep. 20, 1994

[54] DAMPENING SYSTEM

[75] Inventors: John MacPhee, Rowayton, Conn.; Larry E. Lester, Anaheim, Calif.

Reexamination Request:
No. 90/003,156, Aug. 11, 1993

[73] Assignee: Baldwin Technology Corporation, Stamford, Conn.

Reexamination Certificate for:

| | |
|---|---|
| Patent No.: | **4,724,764** |
| Issued: | **Feb. 16, 1988** |
| Appl. No.: | **58,704** |
| Filed: | **Jun. 5, 1987** |

Related U.S. Application Data

[63] Continuation of Ser. No. 797,950, Nov. 14, 1985, which is a continuation-in-part of Ser. No. 560,506, Dec. 12, 1983, abandoned, which is a continuation-in-part of Ser. No. 493,440, May 11, 1983, abandoned.

[51] Int. Cl.[5] ..... B41L 25/02; B41M 1/00

[52] U.S. Cl. ..... 101/451; 101/148; 101/349

[58] Field of Search ..... 101/142, 147, 148, 350, 101/425, 450.1, 451, 483, 492, 493

[56] References Cited

U.S. PATENT DOCUMENTS

| | | | |
|---|---|---|---|
| 2,101,322 | 12/1937 | Reed . | |
| 3,191,528 | 6/1965 | Jorgensen . | |
| 3,433,155 | 3/1969 | Norton . | |
| 3,467,008 | 9/1969 | Domotor | 101/148 |
| 3,769,909 | 11/1973 | Fugman et al. . | |
| 3,926,116 | 12/1975 | Wildeman | 101/352 |
| 3,937,141 | 2/1976 | Dahlgren . | |
| 4,088,074 | 5/1978 | Dahlgren et al. | 101/350 |
| 4,130,056 | 12/1978 | Mabroun et al. | 101/147 |
| 4,287,828 | 9/1981 | Dahlgren | 101/350 |
| 4,290,360 | 9/1981 | Fischer | 101/148 |
| 4,440,081 | 4/1984 | Beisel . | |
| 4,453,463 | 6/1984 | Dahlgren et al. | 101/350 |

FOREIGN PATENT DOCUMENTS

| | | |
|---|---|---|
| 1761245 | 2/1971 | Fed. Rep. of Germany . |
| 2822350 | 12/1978 | Fed. Rep. of Germany . |
| 293210 | 5/1981 | Fed. Rep. of Germany . |
| 2213851 | 9/1974 | France . |
| 1220385 | 1/1971 | United Kingdom . |
| 2007156 | 5/1979 | United Kingdom . |
| 2076339 | 12/1981 | United Kingdom . |

OTHER PUBLICATIONS

"The LTF Press Inkometer" American Ink Maker Dec. 1954 pp. 27–29.

"The Ink-Water Balance in Printing" Research Progress, Lithographic Technical Foundation, No. 32, pp. 1–4, Oct. 1954.

"The LTF Press Inkometer and the Automatic Control of Press Dampening" Press Department Mem No. 5, Lithographic Technical Foundation, Feb. 8, 1962, 4 pages.

"Adjustment Procedure" booklet for the Dahlgren coater-dampener system dated Sep. 12, 1978.

Blair, R. (ed), "The Lithographers Manual", Sixth edition, dated 1980.

"Dahlgren Coater-Dampener System" brochure dated 1981.

MacPhee, J., "Trends in Litho Dampening Systems Show Vast Improvements in Designs", Graphic Arts Monthly, dated Apr. 1981.

"New Dahlgren Photo-Mechanical Printing System" promotional brochure dated Apr. 20, 1982.

"Instruction Book (Preliminary Release)", for the Miehle-Matic Dampener System, Miehle-Goss-Dexter, Inc., dated Aug. 15, 1968.

*Primary Examiner*—Eugene H. Eickholt

[57] ABSTRACT

The invention relates to a system for applying dampening fluid to the plate cylinder of printing presses which is particularly adapted to contacting continuous dampening systems. The dampening fluid applying roller is in contact with the rotating plate cylinder and there is a wiping action between the dampening fluid applying roller and the plate cylinder which loosens foreign particles from the plate cylinder so they can be removed. The dampening fluid applying roller rotates at a different speed than the plate cylinder to cause the wiping action. Preferably, the dampening fluid applying roller rotates at a slower speed than the plate cylinder. In another form of the invention an ink receptive roller is driven at the same speed as the dampening or delta roller while in contact with the dampening roller.

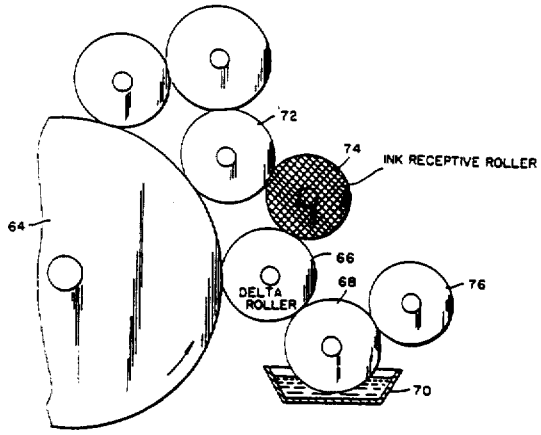

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1-10 is confirmed.

* * * * *